US005452542A

United States Patent [19]

Bardwell

[11] Patent Number: 5,452,542

[45] Date of Patent: Sep. 26, 1995

[54] SECURITY BARRIER APPARATUS

[76] Inventor: Allen E. Bardwell, Salt Lick Rd. High Knob Estates, Front Royal, Va. 22630

[21] Appl. No.: 328,527

[22] Filed: Oct. 25, 1994

[51] Int. Cl.[6] ..... E01F 13/00

[52] U.S. Cl. ..... 49/34; 49/9; 49/322

[58] Field of Search ..... 49/34, 9, 322; 160/328

[56] References Cited

U.S. PATENT DOCUMENTS

| | | | |
|---|---|---|---|
| 353,368 | 11/1886 | Miller . | |
| 484,572 | 10/1892 | Rudert . | |
| 2,663,103 | 12/1953 | Ellison | 49/34 |
| 4,333,268 | 6/1982 | Dumbeck . | |
| 4,553,739 | 11/1985 | Baines | 49/34 X |
| 5,245,787 | 9/1993 | Swenson et al. . | |

*Primary Examiner*—Philip C. Kannan
*Attorney, Agent, or Firm*—Dowell & Dowell

[57] ABSTRACT

A security barrier apparatus suitable for use in residential, farm and industrial settings. The apparatus includes a motor, a cable, a chain secured to the cable and a brake mechanism for engaging the chain. The apparatus is adapted to be mounted to a first support such as a post. The chain extends from the first support to a second spaced support and is raised and lowered relative to the ground by operation of the motor. The motor may be remotely actuated by an electronic transmitter. The apparatus further includes protective features to prevent damage to the motor in the event that a vehicle collides with the chain.

20 Claims, 6 Drawing Sheets

SECURITY BARRIER APPARATUS

TECHNICAL FIELD

The present invention relates to the field of gates and, more particularly, to an automated security barrier apparatus suitable for use in residential, farm and industrial settings.

BACKGROUND OF THE RELATED ART

Automated apparatuses for opening and closing gates have had a long history of development. Such apparatuses have been developed to secure against entry into areas, and to allow individuals to enter such areas without having to exit from their vehicles. The known apparatuses have included, for example, powered gates having laterally sliding metal gates, folding metal doors, and bars that are raised and lowered.

Chains have also been used as an entry barrier in security gate apparatuses. The known apparatuses have included, for example, link chains anchored on one side of a drive leading to a secured area and locked on the opposite side of the drive. These apparatuses have required individuals to leave their vehicles, lower the chain, drive through, and then stop and reattach and lock the chain. Such apparatuses have been inadequate due to the time required to perform these manual steps, especially in bad weather and in poorly lighted areas were personal safety has been a concern.

Entry barrier apparatuses utilizing a chain are disclosed in U.S. Pat. No. 353,368 to Miller, U.S. Pat. No. 484,572 to Rudert and U.S. Pat. No. 4,333,268 to Dumbeck. The disclosed apparatuses include moving components which are installed underground. Consequently, the components are exposed to water and to sleet and ice in colder environments, causing accelerated wear of the apparatuses.

A cable gate apparatus is disclosed in U.S. Pat. No. 5,245,787 to Swenson et al., which includes a slide member mounted in a track to raise a lift arm and gate cable to a raised position.

In view of the above-described inadequacies of the known security barriers, there has been a need for a chain-type security barrier apparatus which is remotely actuated by persons without having to leave the safety and comfort of their vehicles, durable, weather resistant, simple in construction and easy to install.

SUMMARY OF THE INVENTION

The present invention has been made in view of the above-described inadequacies of the known security barrier apparatuses and has as an object to provide a chain-type security barrier apparatus which is remotely actuated.

Another object of the present invention is to provide a security barrier apparatus which is weather resistant.

A further object of the invention is to provide a security barrier apparatus which is durable, simple in construction and easy to install.

A still further object of the invention is to provide a security barrier apparatus having protective features to prevent the apparatus being damaged by a vehicle colliding with the chain.

To achieve the foregoing objects and advantages of the invention, as embodied and broadly described herein, the security barrier apparatus in accordance with the preferred embodiment of the invention is suitable for use with spaced first and second supports which protrude upwardly from a surface. The apparatus is adapted to be mounted to one of the supports. The apparatus comprises a reversible motor, a reel which is connected to and rotatably driven by the motor, and a cable secured to the reel. The cable is wound and unwound on the reel by operation of the motor in respective winding and unwinding directions.

A chain is secured to the cable and is adapted to extend from the first support to the second support. The chain is raised above the surface by operation of the motor in the winding direction, and is lowered onto the surface by operation of the motor in the unwinding direction.

The apparatus further comprises a brake means for engaging the chain. The brake means defines an opening in which the chain is engaged when the motor is deactivated. The chain may move through the opening when the brake means is in a non-braking condition in which the motor is operating.

The apparatus may further comprise a limiting means for limiting the length of chain which may be protracted when the brake means is in the non-braking condition.

Finally, the apparatus may comprise a housing to surround the moving components and protect them from precipitation.

DETAILED DESCRIPTION OF THE PREFERRED

Figure 1:
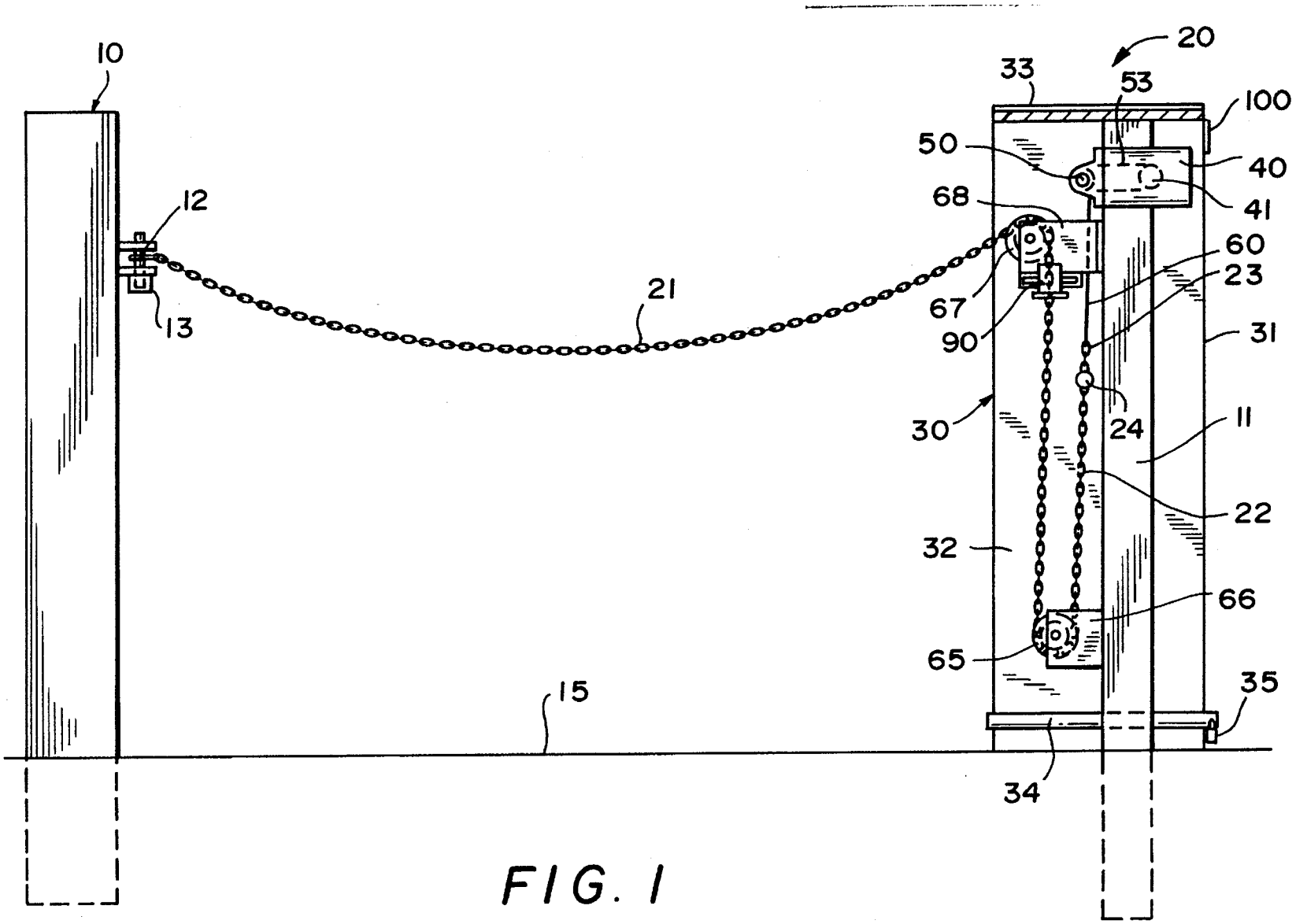
FIG. 1 is a side elevational view illustrating a security barrier apparatus in accordance with a preferred embodiment of the invention, with the barrier in a raised position.

FIG. 1 illustrates a security barrier apparatus 20 in accordance with a preferred embodiment of the invention, as used in combination with a pair of spaced support posts 10, 11. The posts are partially embedded in the ground on opposite sides of a drive 15 which leads to a secured area. It will be understood that the apparatus may be mounted to any type of post, pole or fence, or to trees and the like.

The apparatus 20 comprises a chain 21 which is adapted to extend between the posts 10, 11 and, in the illustrated raised position, form a barrier to vehicles. The chain is shown secured to a bracket 12 by a fastener 13. The chain may be locked to the post 10 to prevent it from being disconnected.

The apparatus 20 further comprises a housing 30 which is adapted to be mounted to the post 11 and surround the moving components of the apparatus. As shown in FIG. 1, the housing includes a back wall 31, side walls 32 (only one sidewall is shown), and a top wall 33. The top wall 33 is secured to the upper end of the post 11, and the back wall 31 is secured to a lower portion of the post by a rod 34 or the like, which in turn is fastened to the post. The rod is preferably secured to the housing by a lock 35 to prevent the housing from being separated from the post. The housing is open at the bottom and includes a front wall (not shown) which is removable from the remainder of the housing to access the enclosed components. The front wall defines an opening (not shown) through which the chain extends.

The housing 30 protects the enclosed components of the security barrier apparatus from being exposed to rain and other forms of precipitation which accelerate wear. The housing is preferably formed of a lightweight, weather resistant material such as fiberglass and the like, to enable the housing to be easily removed from the post 11 for repair purposes. The housing may optionally be formed of a more rigid material such as a metal. In addition to protecting the enclosed components, the housing improves the appearance of the apparatus.

The apparatus 20 further comprises a motor 40 which is mounted to the post 11 near its upper end. The motor is reversible and is preferably electrically powered. The motor may optionally be powered by a battery or a solar energy device (not shown). The motor is preferably be actuated by an electronic transmitter carried in a vehicle. In this manner, when the chain 21 is raised, only persons having such a transmitter may operate the motor to lower the chain. Referring to FIG. 1, the motor may optionally be actuated by an electronic keypad 100 mounted, for example to the housing 30, to enable those individuals not having a transmitter, but having knowledge of an operating code, to lower the chain.

Figure 3:
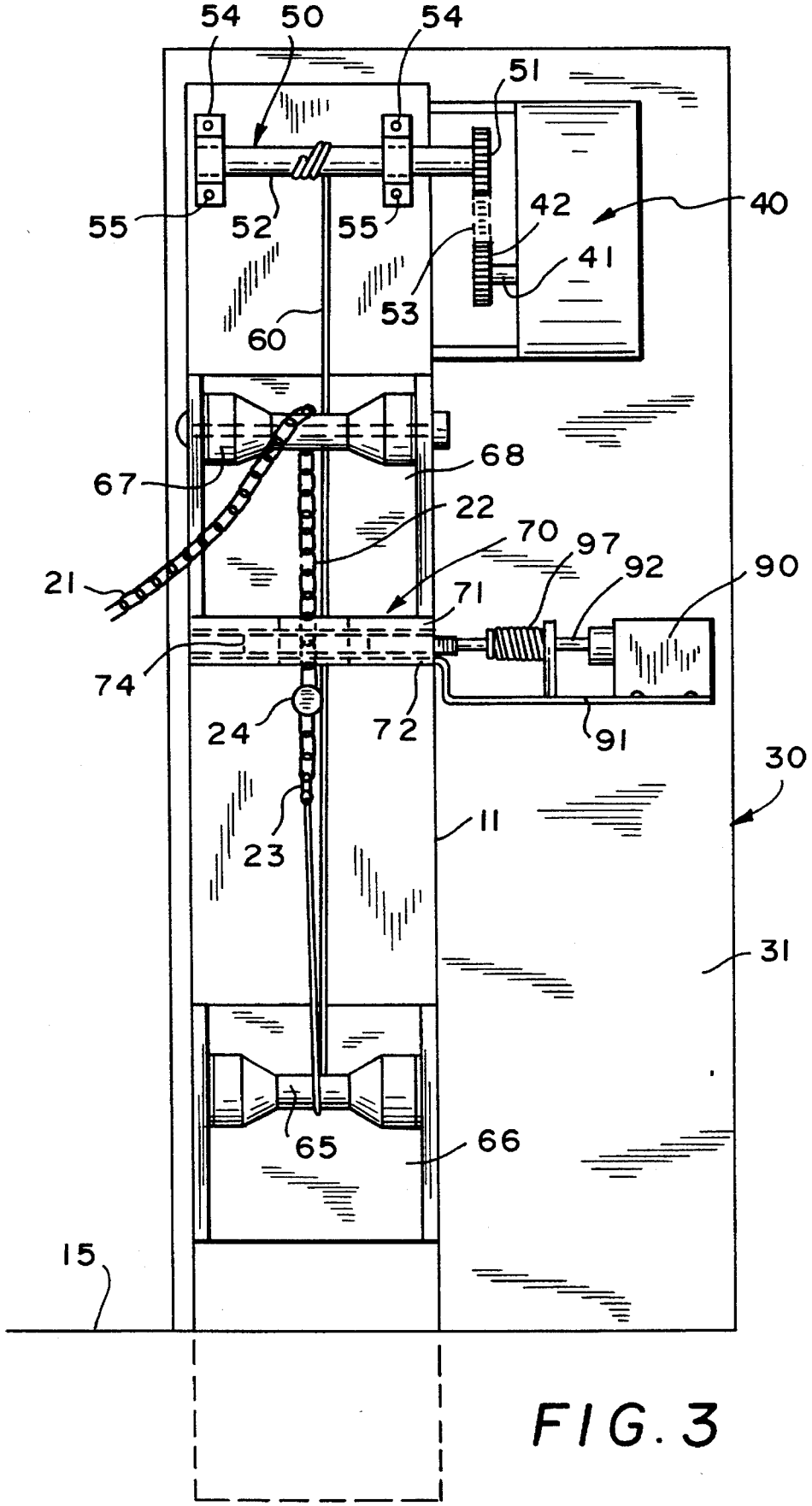
FIG. 3 is a front elevational view of the security barrier apparatus in the direction of line 3—3 of FIG. 2.

As illustrated in FIG. 3, the motor 40 includes a drive shaft 41 and a drive sprocket 42 mounted on the drive shaft.

A winch-type reel 50 is mounted to the post 11 above the motor 40. The reel includes a reel sprocket 51 mounted on a reel shaft 52. A connecting chain 53 connects the drive sprocket 42 of the motor to the reel sprocket. The reel shaft and reel sprocket are held in position by two spaced pillow blocks 54. The pillow blocks are secured to the post by fasteners 55.

A cable 60 is attached at one end to the reel shaft 52 and is connected at its opposite end at 23 to the chain 21. The cable is wound and unwound by reverse operation of the motor, to cause the chain to be retracted and protracted, respectively, from within the housing. As shown in FIG. 1, the cable extends downward from the reel close to the post 11 to prevent interference with the chain.

The reel 50 enables the cable 60 to be used to move the chain 21, instead of using a relatively larger reel to wind up and store the chain. Because the cable is relatively small in diameter, the reel is also small in diameter. Consequently, the reel requires reduced torque or power to lift the cable and chain. The small diameter of the reel shaft creates a maximum amount of leverage and decreases the stress on the motor when a heavy chain is wound.

The length of the chain 21 is selected so that in the raised position shown in FIG. 1, the chain extends downward from the cable 60 and around a lower pulley 65 mounted to the post 11 by a bracket 66, upward around an upper pulley 67 mounted to the post 11 above the lower pulley by a bracket 68, and across the drive 15 to the post 10.

Referring to FIG. 3, the chain 21 preferably includes a frangible link 22 located near the connection 23 between the cable 60 and the chain. The frangible link has a small section removed so that it opens and releases the major portion of the chain from the cable when subjected to a predetermined stress. This prevents any potentially damaging stress being transmitted through the chain and to the drive shaft 41 and drive sprocket 42 of the motor 40. The tension of the chain looping around the lower pulley 65, the upper pulley 67 and the reel 50, is sufficient to enable the frangible link to open when subjected to the predetermined stress. The predetermined stress is below a stress level which may damage the reel or the motor.

The posts 10, 11 are preferably anchored in cement (not shown) to support the extended chain and remain upstanding if a vehicle collides with the apparatus.

Figure 2:
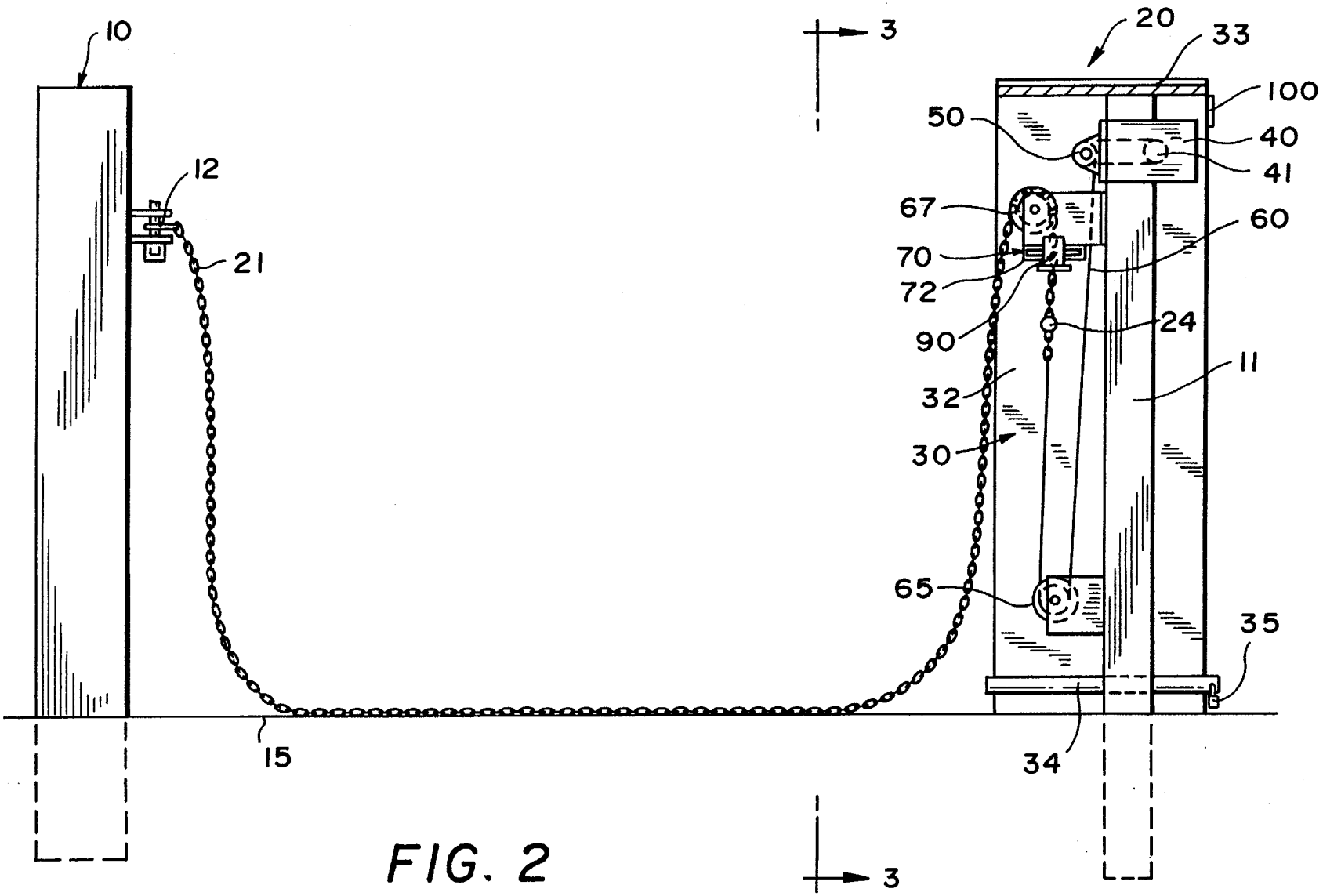
FIG. 2 is a side elevational view illustrating the barrier of the apparatus of FIG. 1 in a lowered position.

The apparatus further comprises means for limiting the length of chain which may be protracted from the apparatus. The limiting means preferably comprises a circular-shaped stop 24 disposed on the chain near the connection 23. As illustrated in FIG. 2, when the chain is lowered, the stop 24 is positioned near the lower surface of a brake means 70 for engaging the chain. If a vehicle engages the chain when the brake means is in a non-braking condition, the stop abuts the lower surface of the brake means and prevents additional chain from being protracted. Consequently, if the chain is subjected to a stress higher than the predetermined strength of the frangible link 22, the frangible link opens and releases the chain to prevent damage to the reel 50 and motor 40.

Figure 4:
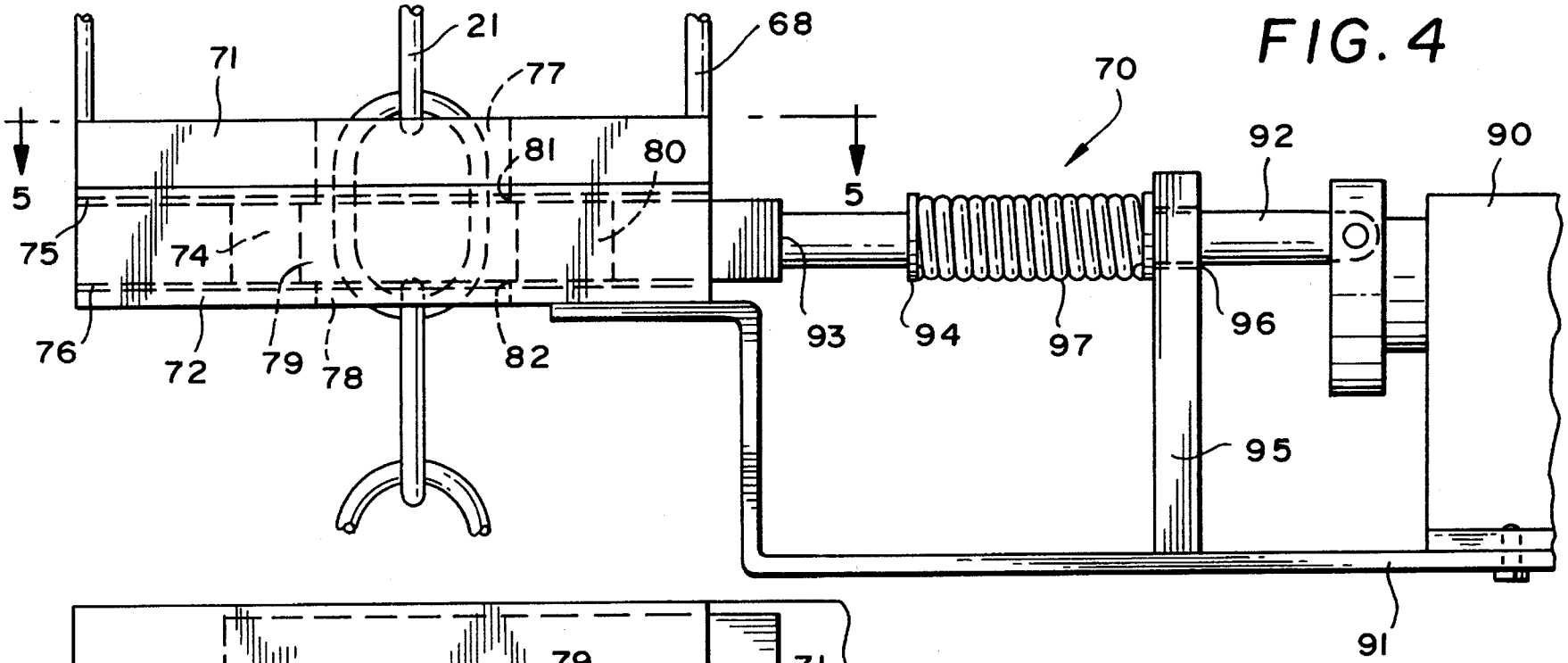
FIG. 4 is a side elevational view of a portion of the chain brake mechanism of the security barrier apparatus in a non-braking condition.
Figure 9:
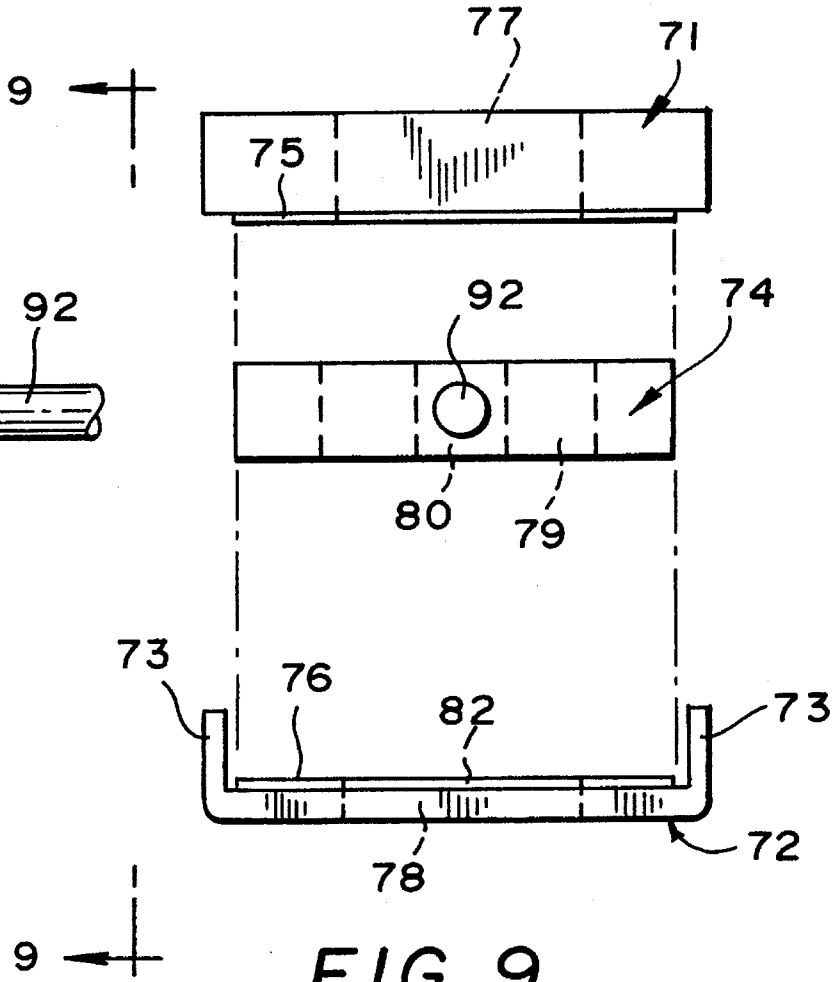
FIG. 9 is an exploded front view in the direction of line 9—9 of FIG. 8.
Figure 8:
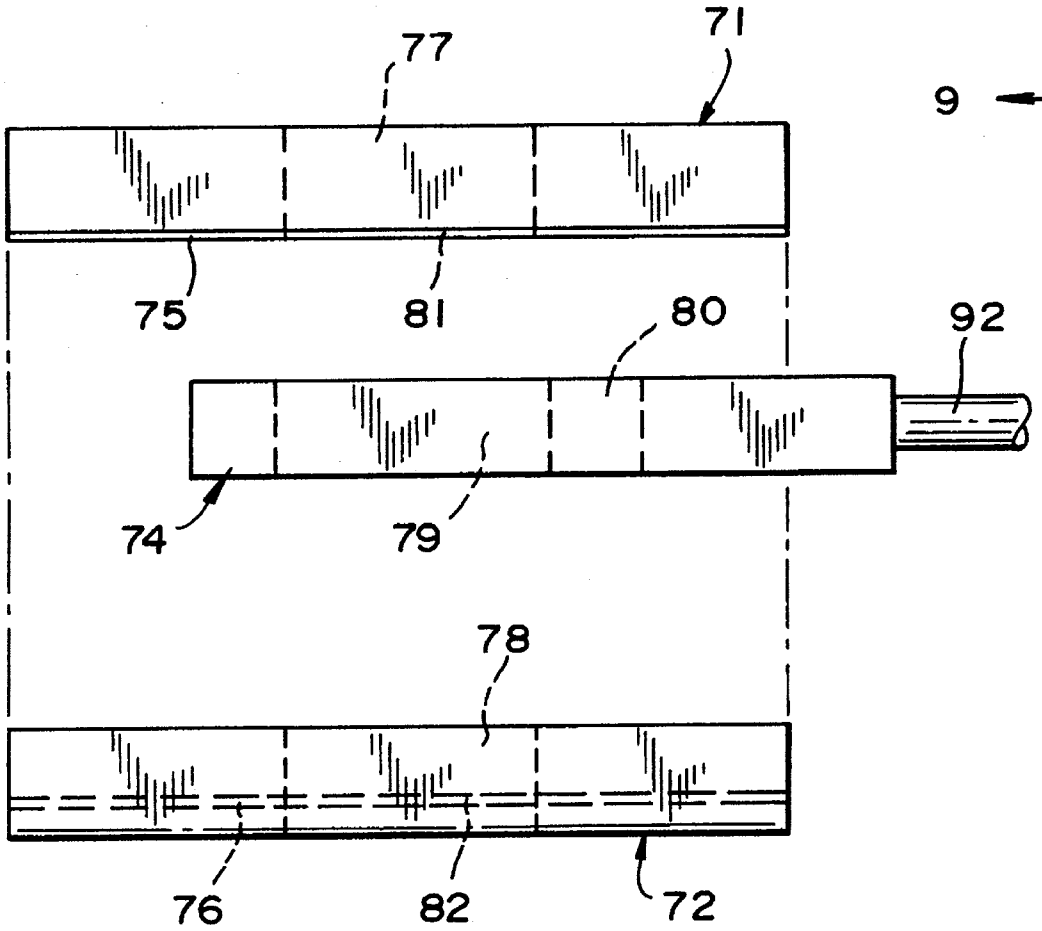
FIG. 8 is an exploded side view illustrating the fixed plates and sliding plate of the chain brake.

As illustrated in FIG. 4, the brake means 70 preferably comprises a solenoid-controlled chain brake mechanism. The chain brake includes an upper fixed plate 71 and a lower fixed plate 72. With reference to FIG. 9, the lower fixed plate 72 has a U-shaped cross-section and includes upward extending sidewalls 73 which are attached to the upper fixed plate 71. The fixed plates are secured to the bracket 68. As shown in FIG. 3, the bracket 68 is fastened to the post 11.

Referring to FIG. 4, a sliding plate 74 is disposed between the fixed plates. Lubricating plates 75, 76 of a lubricating material such as TEFLON™ are placed between the fixed plates 71, 72 and the sliding plate to enable the sliding plate to slide with reduced friction.

Figure 5:
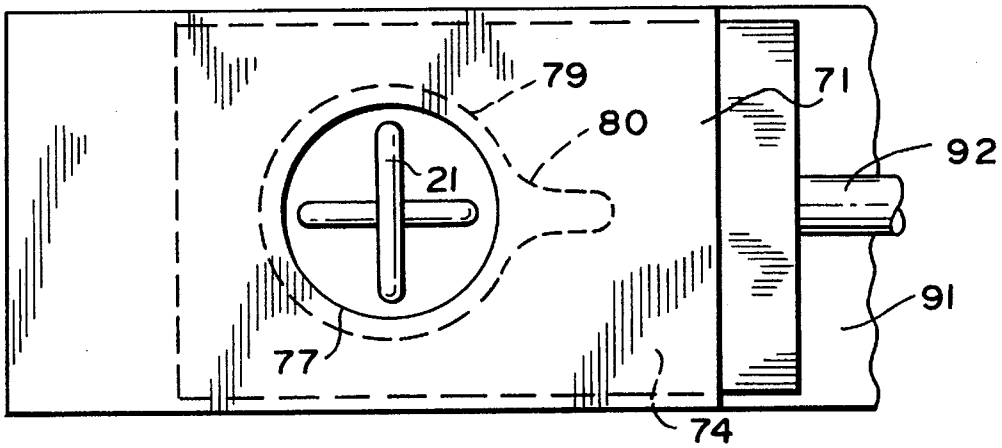
FIG. 5 is a top plan view in the direction of line 5—5 of FIG. 4, showing the sliding plate of the chain brake in a retracted position.

The fixed plates 71, 72 define aligned, preferably circular shaped openings 77, 78, respectively. Referring to FIG. 5, the sliding plate 74 defines an opening having a circular portion 79 and an elongated portion 80 in communication with the circular portion. The lubricating plates 75, 76 also include circular shaped openings 81, 82, respectively (FIG. 4), which are aligned with the circular openings in the fixed plates. The circular openings of the fixed plates and the lubricating plates, and the circular portion of the opening of the sliding plate, are of approximately the same diameter, which is selected to allow the chain to pass through the plates. The circular opening of at least the lower fixed plate 72 is smaller than the diameter of the stop 24 to limit the upward movement of the stop and, thus, the chain 21. At its uppermost position, the stop abuts the bottom face of the lower fixed plate 72 and prevents further upward movement of the chain. With further reference to FIG. 4, the chain brake 70 comprises a solenoid 90 which is mounted on a bracket 91 secured to the lower fixed plate 72. The solenoid includes a retractable shaft 92 which is attached at its tip 93 to the sliding plate 74. A first, fixed vertical plate 94 is disposed on the shaft. A second, fixed vertical plate 95 is mounted to the bracket 91 and defines an opening 96 through which the shaft 92 reciprocates when the solenoid is actuated and deactivated. A coil spring 97 is positioned on the shaft between the plates 94, 95.

As illustrated in FIG. 4, when the solenoid 90 is actuated, the shaft 92 and sliding plate 74 are pulled away from the fixed plates 71, 72, and the spring 97 is compressed between the vertical plates 94, 95. When the shaft is fully retracted as shown, the circular portion 79 of the opening of the sliding plate is aligned with the openings 77, 78 in the fixed plates 71, 72, respectively, and the openings 81, 82 in the lubricating plates 75, 76, respectively. As shown in FIG. 5, the chain is able to move upward and downward through the chain brake.

Figure 6:
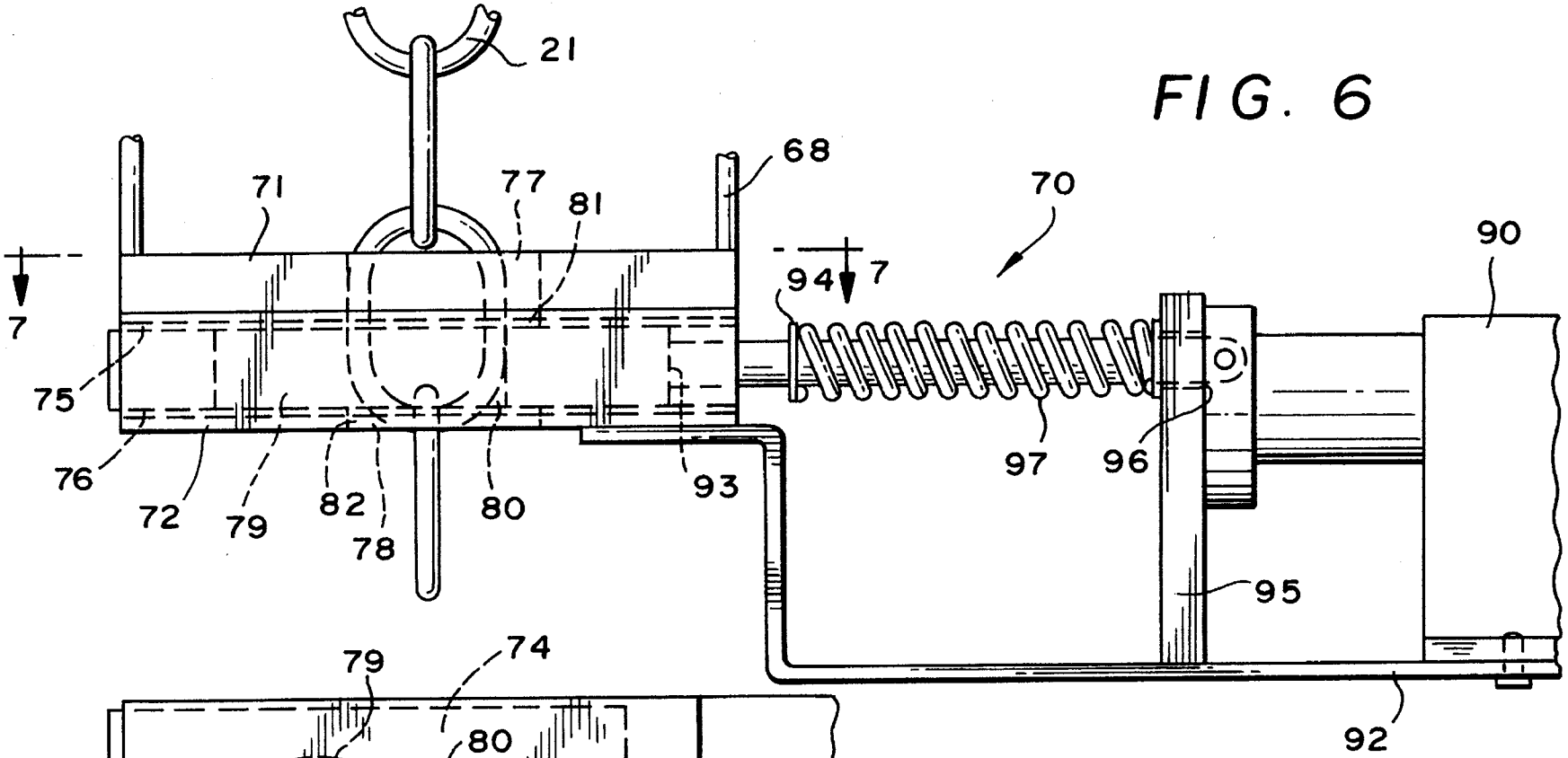
FIG. 6 is a side elevational view of a portion of the chain brake of the security barrier apparatus in a braking condition in which the chain is engaged by the sliding plate.
Figure 7:
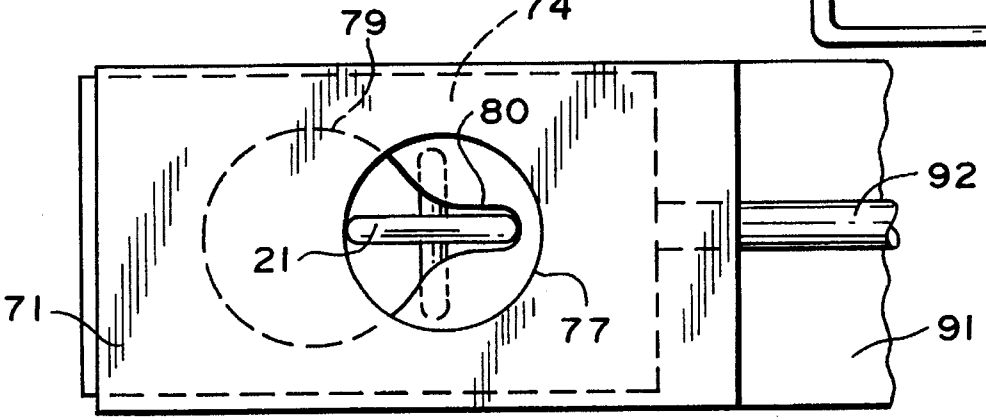
FIG. 7 is a top plan view in the direction of line 7—7 of FIG. 6, showing the sliding plate in a chain-engaging position.

Referring to FIG. 6, when the motor 40 and solenoid 90 are deactivated, the spring 97 expands and pushes the shaft 92 and sliding plate 74 toward the fixed plates 71, 72. When the shaft is fully protracted as illustrated, the circular portion 79 of the opening of the sliding plate is out of alignment with the openings 77, 78 in the fixed plates and the openings 81, 82 in the lubricating plates. Referring to FIG. 7, the elongated portion 80 of the opening of the sliding plate engages the chain 21 and prevents movement of the chain relative to the chain brake. The range of movement of the shaft 92 is limited by the vertical plate 95.

When an individual in a vehicle reaches the security chain barrier, the chain 21 is lowered as illustrated in FIG. 2 to allow the vehicle to drive over it. To lower the chain, the motor 40 is actuated by an electronic transmitter located in the vehicle to cause the reel 50 to unwind the cable. The solenoid 90 is actuated simultaneously with the motor and remains in the non-braking condition shown in FIG. 4 until the motor is deactivated when the chain is fully lowered. The chain links pass through the plates until the chain achieves its lowered position.

Once the chain 21 is fully lowered, the motor 40 and solenoid 90 are simultaneously deactivated by a preset travel limit switch located within the motor. The compressed spring 97 expands and pushes the retractable shaft 92 and sliding plate 74 toward the fixed plates and into the position shown in FIG. 6. In this position of the sliding plate, any large stress exerted on the chain causes the frangible link to open and release the chain.

The apparatus is designed to allow a sufficient length of chain to be protracted so that when the chain is lowered as illustrated in FIG. 2, it rests on a substantial portion of the drive 15 between the posts 10, 11. This allows wide vehicles to drive over the chain without running into the downward extending portions of the lowered chain and possibly causing the frangible link 22 to release the chain.

Once the vehicle drives over the chain, the chain is lifted to the raised position illustrated in FIG. 1. To raise the chain, the motor 40 and solenoid are again actuated to wind the cable on the reel 50 and lift the chain.

Once the chain is raised, the motor and solenoid are deactivated. The sliding plate engages the chain and prevents its further movement. If a vehicle drives into the chain, the frangible link 22 may release the chain and prevent damage to the cable 60, reel 50 and drive shaft 41, as explained above.

Referring to FIG. 3, stress on the motor 40 and drive shaft 41 are limited by the location, orientation and diameter of the reel 50. The reel shaft 52 is approximately perpendicular to the drive sprocket 42 of the motor. Any external downward force transmitted to the reel through the chain 21 and cable 60 is absorbed by the reel and the pillow blocks 54 and does not damage the drive shaft of the motor.

The foregoing description of the preferred embodiment of the invention has been presented to illustrate the principles of the invention and not to limit the invention to the particular embodiment illustrated. It is intended that the scope of the invention be defined by all of the embodiments encompassed by the following claims, and their equivalents.

What is claimed is:

1. A security barrier apparatus suitable for use with spaced first and second supports which protrude upwardly from a surface, the apparatus comprising:

a reversible motor adapted to be mounted to the first support;

a reel connected to and rotatably driven by said motor;

a cable having a first end secured to said reel, said cable being wound and unwound on said reel by operation of said motor in respective winding and unwinding directions;

a chain having an end secured to a second end of said cable and being adapted to extend from the first support and be secured to the second support, said chain being raised above the surface by operation of said motor in said winding direction, and said chain being lowered onto the surface by operation of said motor in said unwinding direction; and brake means adapted to be mounted to the first support for engaging said chain, said brake means defining an opening and said chain being engaged in said opening in a braking condition in which said motor is deactivated, said chain being capable of moving through said opening when said brake means is in a non-braking condition in which said motor is operating.

2. The apparatus of claim 1, further comprising a housing adapted to be secured to the first support and to surround said motor, said reel and said brake means.

3. The apparatus of claim 1, further comprising means for limiting the length of chain which may be protracted from the apparatus when said brake means is in the non-braking condition.

4. The apparatus of claim 3, wherein the limiting means comprises a stop disposed on said chain, said stop is larger than said opening in said brake means such that said stop is unable to pass through said opening and limits movement of said chain relative to said brake means.

5. The apparatus of claim 1, wherein said chain includes a frangible link which opens and releases said chain from said cable when a predetermined stress is applied to said chain.

6. The apparatus of claim 1, wherein said brake means comprises first and second fixed plates, a sliding plate disposed between the fixed plates, a solenoid including a retractable shaft secured to said sliding plate, and a spring disposed on said retractable shaft, said solenoid is simultaneously actuated with said motor to pull said sliding plate toward said solenoid and compress said spring in the non-braking condition, and said solenoid is simultaneously deactivated with said motor to cause said spring to expand and push said sliding plate away from said solenoid so as to engage said chain in the braking condition.

7. The apparatus of claim 6, wherein the fixed plates each define a circular opening and the circular openings being aligned with each other, said sliding plate defines a circular opening portion and an elongated opening portion in communication with said circular opening portion, said circular opening portion being substantially aligned with the circular openings in the fixed plates in the non-braking condition, and said circular opening portion being substantially non-aligned with the circular openings in the fixed plates and said chain being received in said elongated opening portion and engaged by said sliding plate in the braking condition.

8. The apparatus of claim 7, further comprising a lubricating plate disposed between each of the fixed plates and said sliding plate, the lubricating plates each define a circular opening which is aligned with the circular openings in the fixed plates.

9. The apparatus of claim 1, wherein said motor comprises a drive shaft and a drive sprocket disposed on said drive shaft, said reel comprises a reel shaft and a reel sprocket disposed on said reel shaft, a connecting chain connects said drive sprocket to said reel sprocket such that said reel shaft is rotatably driven by said drive shaft, said reel shaft being approximately perpendicular to said reel sprocket and said drive sprocket.

10. The apparatus of claim 1, wherein said motor is electrically powered and adapted to be remotely actuated by a wireless transmitter.

11. The apparatus of claim 1, further comprising a first pulley adapted to be mounted to the first support below said brake means, said cable and chain pass about said first pulley when said chain is raised and lowered, and a second pulley adapted to be mounted to the first support above said brake means, said chain being positioned to pass about said second pulley when raised and lowered.

12. A security barrier apparatus for use with spaced first and second supports which protrude upwardly from a surface, the apparatus comprising:

a reversible motor adapted to be mounted to the first support;

a reel connected to and rotatably driven by said motor;

a cable having a first end secured to said reel, said cable being wound and unwound on said reel by operation of said motor in respective winding and unwinding directions;

a chain having an end secured to a second end of said cable and being adapted to extend from the first support and be secured to the second support, said chain being raised above the surface by operation of said motor in said winding direction, said chain being lowered onto the surface by operation of said motor in said unwinding direction, and said chain including a frangible link which releases said chain from said cable when a predetermined force is applied to said chain;

brake means adapted to be mounted to the first support for engaging said chain, said brake means comprises a sliding plate which defines an opening, a solenoid including a retractable shaft secured to said sliding plate, and a spring disposed on said retractable shaft, said solenoid is simultaneously actuated with said motor to pull said sliding plate toward said solenoid and compress said spring in a non-braking condition in which said chain is capable of moving through said opening, and said solenoid is simultaneously deactivated with said motor to cause said spring to expand and push said sliding plate away from said solenoid so as to engage said chain in a braking condition; and means for limiting the length of chain which may be protracted from the apparatus when said brake means is in the non-braking condition.

13. The apparatus of claim 12, further comprising a housing adapted to be secured to the first support and to surround said motor, said reel and said brake means.

14. The apparatus of claim 12, wherein the limiting means comprises a stop disposed on said chain, said stop is larger than said opening in said brake means such that said stop is unable to pass through said opening and limits movement of said chain relative to said brake means.

15. The apparatus of claim 12, wherein said brake means further comprises fixed plates disposed on opposed sides of said sliding plate, said solenoid being mounted on a bracket which is fixedly secured to one of said fixed plates.

16. The apparatus of claim 15, wherein said fixed plates each define a circular opening and the circular openings being aligned with each other, said sliding plate defines a circular opening portion and an elongated opening portion in communication with said circular opening portion, said circular opening portion being substantially aligned with the circular openings in the fixed plates in the non-braking condition, and said circular opening portion being substantially non-aligned with the circular openings in the fixed plates and said chain being received in said elongated opening portion and engaged by said sliding plate in the braking condition.

17. The apparatus of claim 12, wherein said motor comprises a drive shaft and a drive sprocket disposed on said drive shaft, said reel comprises a reel shaft and a reel sprocket disposed on said reel shaft, a connecting chain connects said drive sprocket to said reel sprocket such that said reel shaft is driven by said drive shaft when said motor is operating, said reel shaft is approximately perpendicular to said reel sprocket and said drive sprocket.

18. The apparatus of claim 12, further comprising a first pulley adapted to be mounted to the first support below said brake means, said cable and chain pass about said first pulley when said chain is raised and lowered, and a second pulley adapted to be mounted to the first support above said brake means, said chain being positioned to pass about said second pulley when raised and lowered.

19. A security barrier apparatus suitable for use with spaced first and second supports which protrude upwardly from a surface, the apparatus comprising:

a reversible motor adapted to be mounted to the first support and remotely actuated;

a reel connected to and rotatably driven by said motor;

a cable having a first end secured to said reel, said cable being wound and unwound on said reel by operation of said motor in respective winding and unwinding directions;

a chain having an end secured to a second end of said cable and being adapted to extend from the first support and be secured to the second support, said chain being raised above the surface by operation of said motor in said winding direction, and said chain being lowered onto the surface by operation of said motor in said unwinding direction, said chain including a frangible link which releases said chain from said cable when a predetermined force is applied to said chain;

brake means adapted to be mounted to the first support for engaging said chain, said brake means defining an opening and said chain being engaged in said opening in a braking condition in which said motor is deactivated, said chain being capable of moving through said opening when said brake means is in a non-braking condition in which said motor is operating;

means for limiting the length of chain which may be protracted from the apparatus when said brake means is in the non-braking condition; and a first pulley adapted to be mounted to the first support below said brake means, said cable and chain pass about said first pulley when said chain is raised and lowered, and a second pulley adapted to be mounted to the first support above said brake means, said chain being positioned to pass about said second pulley.

20. The apparatus of claim 19, further comprising a housing adapted to be secured to the first support and to surround said motor, said reel and said brake means.

* * * * *